United States Patent [19]

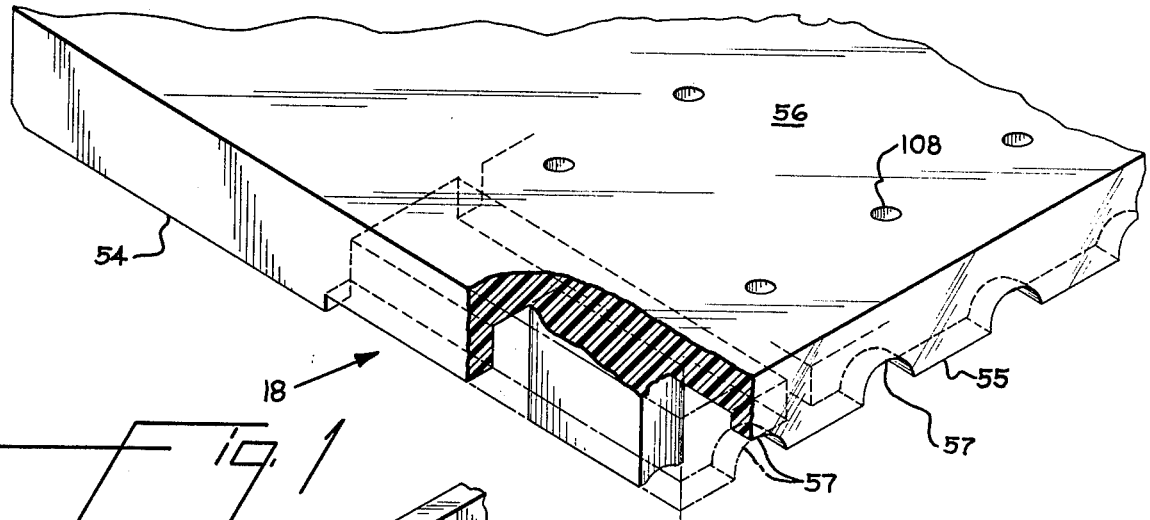
Fig. 1
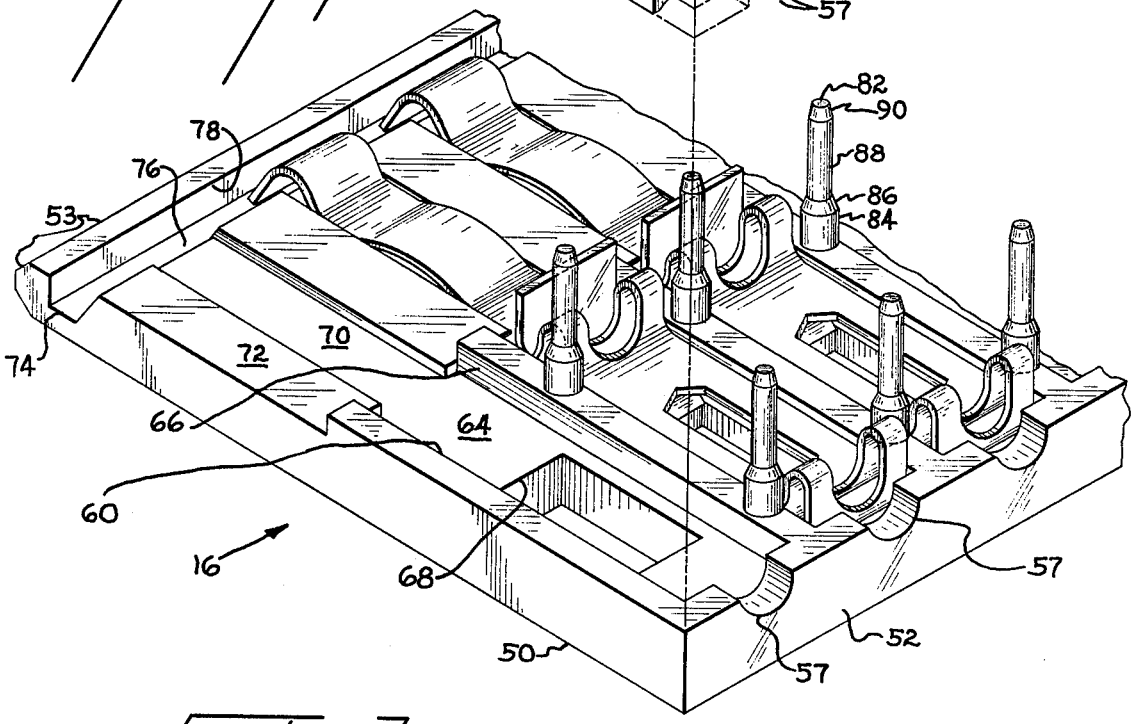
Fig. 2
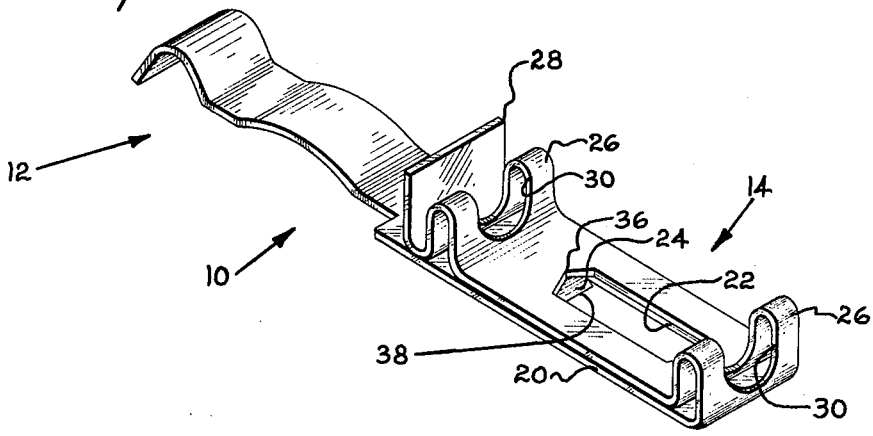

Evans

[11] 4,109,991

[45] Aug. 29, 1978

[54] SELF-STRIPPING ELECTRICAL CONNECTOR AND TERMINAL

[75] Inventor: Robert Franklin Evans, New Cumberland, Pa.

[73] Assignee: E. I. Du Pont de Nemours and Company, Wilmington, Del.

[21] Appl. No.: 614,427

[22] Filed: Sep. 18, 1975

Related U.S. Application Data

[63] Continuation-in-part of Ser. No. 468,689, May 10, 1974, abandoned.

[30] Foreign Application Priority Data

May 8, 1975 [JP] Japan ..... 50-54335
May 8, 1975 [GB] United Kingdom ..... 19484/75

[51] Int. Cl.[2] ..... H01R 13/38
[52] U.S. Cl. ..... 339/99 R
[58] Field of Search ..... 339/97 R, 97 P, 98, 339/99 R

[56] References Cited

U.S. PATENT DOCUMENTS

| | | | |
|---|---|---|---|
| 2,873,435 | 2/1959 | Hubbell | 339/97 R |
| 3,336,564 | 8/1967 | McCaughey | 339/99 R |
| 3,405,385 | 10/1968 | Rapp | 339/97 R |
| 3,611,263 | 10/1971 | Krone | 339/97 R |
| 3,824,527 | 7/1974 | Evans | 339/97 R |
| 3,854,114 | 10/1974 | Kloth | 339/97 R |

*Primary Examiner*—Joseph H. McGlynn

[57] ABSTRACT

An electrical connector for insulated wires comprising a terminal for each wire comprising a flat member having an opening therein including a pair of spaced opposing wire contact lips extending inwardly in said opening, and a pair of insulation-skiving blades, each insulation-skiving blade overlying a contact lip; and an insulated housing including a base and a cover engageable with the base.

10 Claims, 11 Drawing Figures

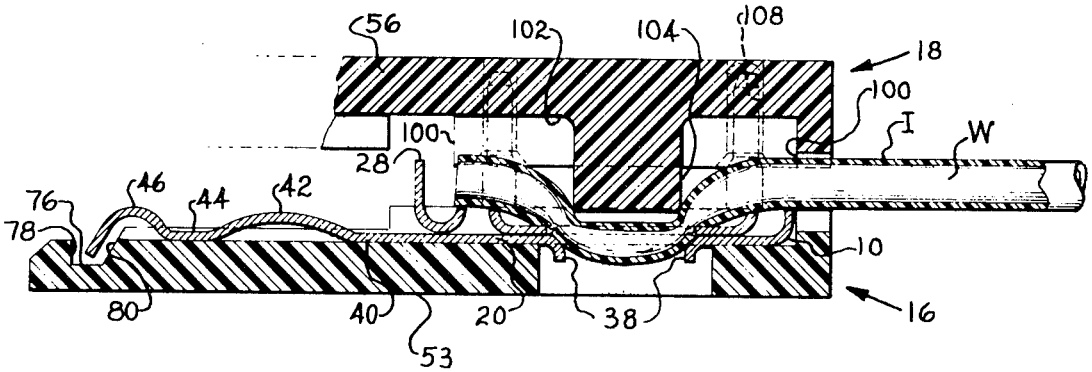

SELF-STRIPPING ELECTRICAL CONNECTOR AND TERMINAL

CROSS-REFERENCE TO RELATED APPLICATION

This application is a continuation-in-part application of U.S. Ser. No. 468,689, filed May 10, 1974, now abandoned.

BACKGROUND OF THE INVENTION

1. Field of the Invention

The present invention relates to solderless electrical connectors and terminals, and particularly relates to insulation-piercing or self-stripping electrical connectors and terminals.

2. Description of the Prior Art

Electrical connectors including spring contact terminals and self-stripping wire terminals for connecting a plurality of insulated conductors to modular electronic circuit assemblies and terminals are well-known in the prior art. A connector for terminating conductors for multi-conductor terminals is described in U.S. Pat. No. 3,668,301, wherein an insert is used for forcing an insulated pair of electrical conductors into a cavity to destroy the electrical insulation and cause an electrical contact between the conductors and a conductive insert in the cavity. An electrical connector having an insulated housing with a cavity extending therethrough and an electrically conductive wedge is described in U.S. Pat. No. 3,772,571. The wedge is driven downward against an insulated wire to break the insulation and provide an electrical connection between a terminal in the housing and the wire and wedge. Electrical connectors including terminals having one or more deeply-slotted plates are described in U.S. Pat. Nos. 3,760,335; 3,824,527; 3,835,444 and 3,854,114. Generally, such connectors including terminals having deeply-slotted plates are limited to use with solid electrical conductors and are not useful with stranded electrical conductors. Additionally, due to the deep slots for receiving the conductors, the overall height or profile of a connector including such terminals is high, and does not provide for the packaging density frequently required in electronic equipment packaging.

The connector of the present invention provides for reliable self-stripping electrical connections for both solid and stranded electrical conductors, and a flat terminal provides for a low-profile and increased packaging density of the electrical connector.

SUMMARY OF THE INVENTION

According to the present invention, there is provided an electrical connector for insulated wires comprising a terminal for each wire comprising a flat member having an opening therein including a pair of spaced opposing wire contact lips extending inwardly in said opening, and a pair of insulation-skiving blades, each insulation-skiving blade overlying a contact lip; and an insulated housing including a base and a cover engageable with the base, the base having a surface for receiving each terminal and an opening in the surface for receiving a wire inserted between the spaced opposing contact lips, and the cover having a surface with a member projecting toward the base for engaging an insulated wire positioned in the connector bridging the insulation-skiving blades and forcing the wire between the blades, skiving the insulation to expose the wire, and engaging the wire with the contact lips, when the cover is engaged with the base.

The electrical connector and terminals of the present invention provide a significant technical advance over deeply-slotted, plate-type, self-stripping electrical connectors by providing rapid and reliable termination of of either solid or stranded electrical conductors over a range of wire sizes and a lower overall profile connector for increased packaging density.

The electrical connector of the present invention provides a versatile electrical interconnection system for electronic circuit assemblies and systems.

BRIEF DESCRIPTION OF THE DRAWINGS

FIG. 1 is a perspective view of an embodiment of an electrical connector according to the invention.

FIG. 2 is a perspective view of an embodiment of a self-stripping terminal of the invention.

DETAILED DESCRIPTION OF A PREFERRED EMBODIMENT

Figure 3:
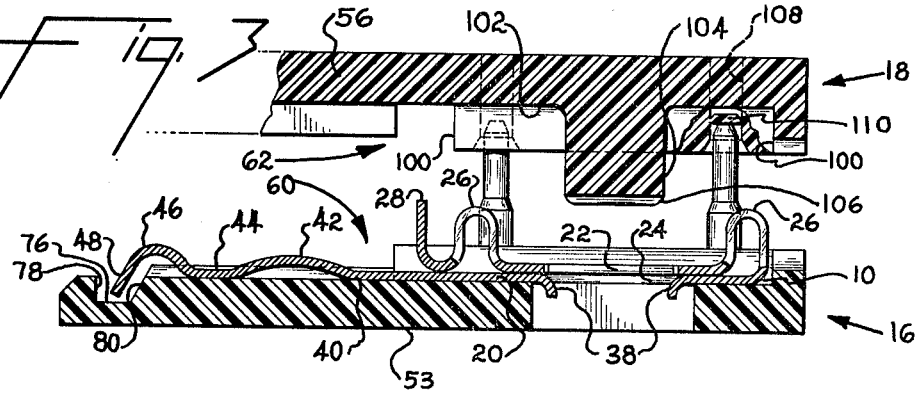
FIG. 3 is an elevation view in section of the embodiment of the connector of FIG. 1.

A connector and contact terminal of the present invention are described below with reference to the attached drawings wherein the same numerals are used throughout to identify the same elements.

The connector comprises a terminal 10 formed from strip metal spring stock including a contact 12 and a wire terminal 14. A base 16 for receiving the terminal 10, and a cover 18 engageable with the base provides an insulated housing for the terminal and wires inserted therein.

The wire terminal 14 of the terminal 10 is formed by bending and folding a strip having elongated openings 22 and 24 to place opening 22 in an overlying relationship with opening 24 and provide upstanding wire guide members 26 and wire stop 28. Oval openings in strip 20 are bent in a U-shape to provide recesses 30 in wire guides 26 for receiving a wire inserted in the terminal and positioning it bridging the opening 22. Opening 22 is an elongated hexagon having V-shaped opposing ends 36. Opening 24 has contact lips 38 at opposing ends extending inwardly in opening 24. Each opposing end 36 of opening 22 provides an insulation-skiving blade overlying a contact lip 38.

A contact 12 of the terminal 10 extends from the wire terminal 14. The contact 12 having a first flat section 40 extending from terminal 14, a first bowed section 42, a second flat section 44, a second bowed section 46 and a lip 48 extending from bowed section 46 across the plane of strip 20 and first and second flat sections 40 and 44.

The insulated housing includes a base 16 and a cover 18, engageable with the base 16. The base 16 has side walls 50, rear wall 52, and a flat bottom surface 53. The cover 18 has side walls 54, rear wall 55 and a flat top surface 56. Cooperative circular openings 57 in the rear walls of the housing provide for receiving a plurality of wires in the connector. Opposing surfaces 60 and 62 of base 16 and cover 18 have, respectively, recesses 64 for receiving contact terminals 10 and recesses 100, which form cavities for the contact terminals 10. An elongated rectangular through opening 68 is provided in the base 16 in recesses 64 substantially in alignment with openings 22 and 24 in wire terminal 10. Side walls 66 of the recess 64 confine the terminal in the housing. Surfaces 70 in communication with the recesses 64 provide for seating flat sections 40 and 44 of the contact ends 12 of the contact terminals 10, and lands 72 separate the contact ends 12 of terminals 10 from adjacent terminals in the housing. A groove 74 is provided for receiving the lip 48 of the contact end 12 of terminal 10. The groove is parallel to the front of base 16 and has a bottom surface 76, a front surface 78 and an inclined back surface 80. The groove 74 provides a stop for the flexing of the contact 12 of terminal 10 and prevents overstressing of the contact. Posts 82 are provided on the walls 67 between adjacent recesses 64 in base 16. Each post 82 has a first cylindrical section 84, a first frustroconical section 86, a second cylindrical guide section 88, and a second frustro-conical section 90. The opposing surface 62 of cover 18, having recesses 100 therein, has rectangular insertion members 104 projecting from the recessed surface 102. Each member 104 has a concave surface 106 for engaging a wire. Holes 108 in cover 18 coincide with posts 82 and correspond in diameter with the first cylindrical section 84 of post 82 to provide an interference fit and secure the cover 18 on the base 16, when the cover 18 is engaged with the base. Pop-out discs 110 are provided in holes 108 for positioning cover 18 above base 16 during assembly of the connector.

Figure 4:
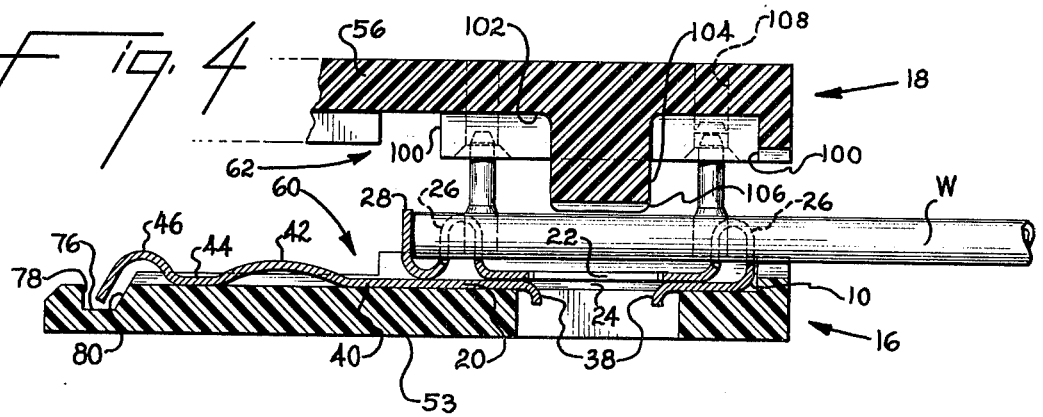
FIGS. 4–6 are elevation views similar to FIG. 3 illustrating the self-stripping action of the connector of the invention.
Figure 5:
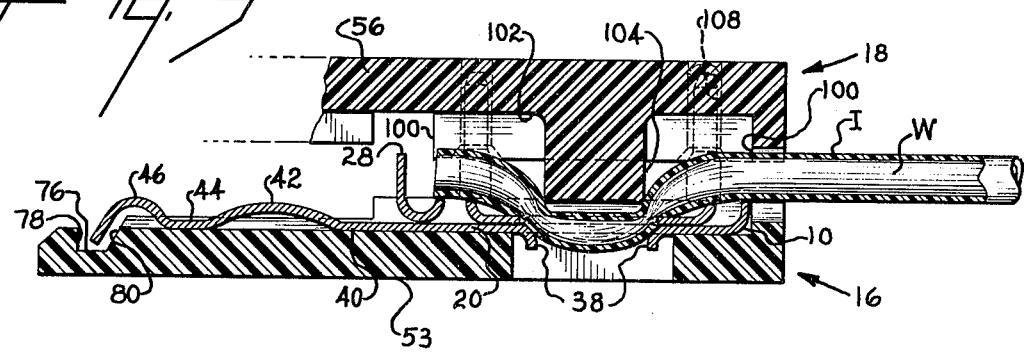
Figure 6:
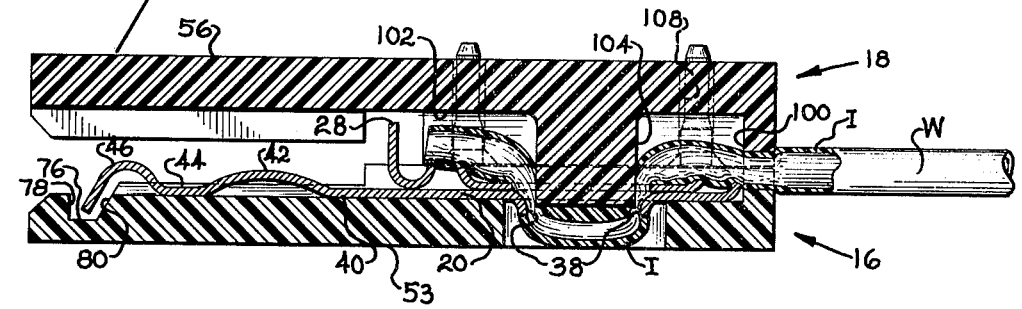

Assembly of a plurality of insulated conductors in the connector assembly and the self-stripping action of the connector assembly can be readily understood with reference to FIGS. 4–6, wherein the self-stripping feature of the connector assembly is illustrated with reference to the wire W having an insulated sheath I.

The cover 18 is positioned over the base 16 having a terminal 10 disposed therein. Pop-out disc 110 in holes 108 support the housing 18 on posts 82 projecting from walls 67 between the recesses 64 in the first housing 16. Each wire W having an insulated sheath I is inserted in wire guide members 26 of the terminal 10 until the end of the wire engages the wire stop member 28 of the terminal 14, and the wire bridges the opening 22 in wire terminal 14. A suitable press is used to force cover 18 downward popping the disc 110 in holes 108 and engaging each concave surface 106 of member 104 with each insulated wire. The cover 18 is forced downward and the member 104 forces the wire against the opposing spaced sharp ends 36 of opening 22 and skives the insulated sheath I to expose the wire W at two points. The conductor is forced downward into opening 24 and the two exposed points of the conductor are engaged with the downturned opposing contact lips 38 of opening 24. The portion of the insulated conductor between the two exposed points is received in opening 68 in base 16, and the two exposed points of the conductor are firmly engaged in electrical contact with the downwardly projecting opposing lips 38 of opening 24 by member 104. The downwardly projecting edges of lips 38 engage the insulated sheath and prevent it from being retracted and interfering with the contact area between lips 38 and the wire. The cover 18 and base 16 are locked together, by the interference fit between cylindrical sections 84 of posts 82 and holes 108 in base 16, providing sufficient pressure between the exposed segments of the wire and lips 38 to insure a reliable electrical connection between the lips 38 of the wire terminal 14 and the wire. The V-shaped ends 36 of opening 22 provide for skiving the insulation I from the wire and insure sufficient clearance between the ends 36 and the insertion member 104 to avoid damage to or severing of the wire W when inserted in the opening 22.

Figure 8:
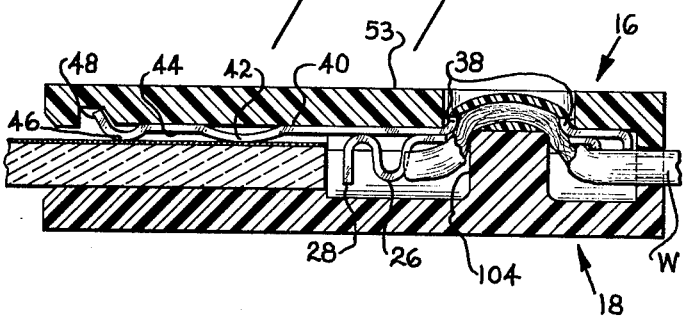
FIGS. 7–9 are elevation views in section illustrating the versatility of the connector of the present invention.
Figure 7:
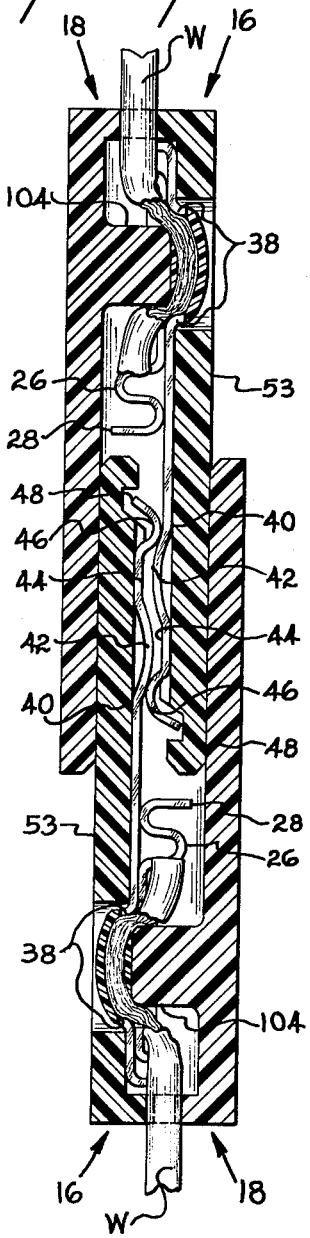
Figure 9:
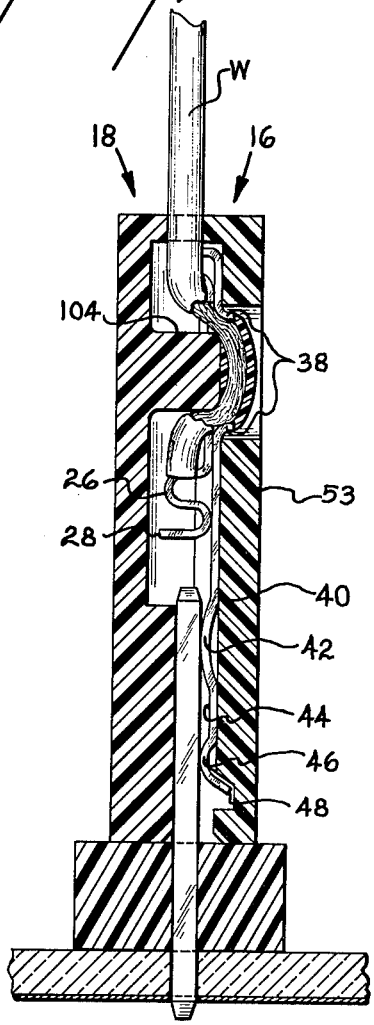

With particular reference to FIGS. 7–9, the versatility of the connector assembly and contact terminal of the present invention is illustrated. FIG. 7 illustrates a wire-to-wire connection using identical connector blocks. FIG. 8 illustrates an interconnection between a wire and a circuit board using a connector of the invention. FIG. 9 illustrates an interconnection between a wire and a conventional square pin disposed in a header block on a printed circuit board.

Figure 10:
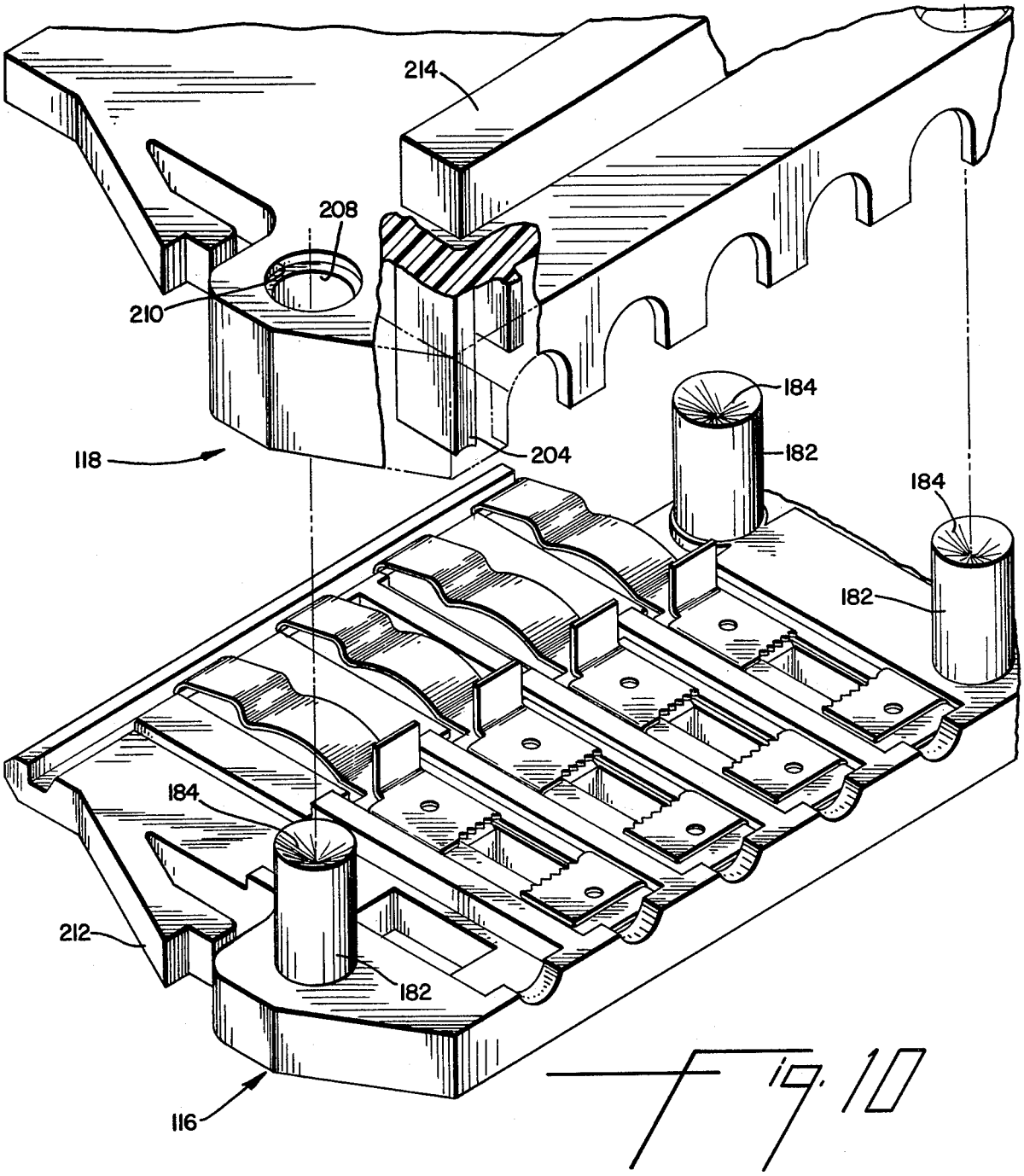
FIG. 10 is a perspective view, similar to FIG. 1, of another embodiment of the connector of the invention.
Figure 11:
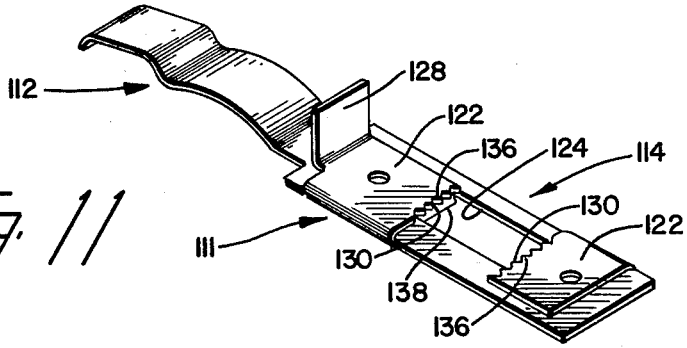
FIG. 11 is a perspective view, similar to FIG. 2, of another embodiment of the self-stripping terminal of the invention.

Another embodiment of a connector according to the invention is illustrated in FIGS. 10 and 11. The connector comprises a terminal 111 formed from strip metal stock including a contact 112 and a wire terminal 114. A base 116 for receiving the terminal 111, and a cover 118 engageable with the base 116 provides an insulated housing for the terminal 111 similar to base 16 and cover 18.

The wire terminal 114 is formed by bending and folding a strip having an elongated opening 124 therein. The insulation skiving blades 122 are folded marginally along opposing edges of the strip to be substantially parallel with the strip and to place each edge 136 of each blade 122 in an overlying relationship with a contact lip 138 (one shown) extending inwardly in an opening 124 at each longitudinally opposing end of the opening 122. Each edge 136 of each blade includes a plurality of V-shaped serrations 130. An upstanding wire stop 128 is provided on blade 122 adjacent the contact 112, which is similar to contact 12. Upstanding cylindrical posts 182 having conical recesses 184 are provided on the base 116. The cover 118 is provided with holes 208 for receiving each post 182. Each hole 208 includes a countersink 210. The self-stripping operation of the connector is similar to the previously-described embodiment. A plurality of insulated wires are inserted in the connector assembly with each insulated wire bridging the insulation skiving blades 122. The cover 118 is engaged with the base and an anvil 204 forces each wire against the opposing V-shaped serrated edges 136 of the insulation-skiving blades 122 and skives the insulation to expose the wire at two points. The two exposed points of the conductor are firmly engaged in electrical contact with the longitudinally opposing lips 138 extending in opening 122. The cylindrical posts 182 on the base 116 are received in corresponding holes 208 in the cover 118. The posts 182 are staked by engaging a suitable tool in the conical recesses 184, e.g. a hot or cold staking tool, to secure the cover 118 and base 116.

Arms 212 (one illustrated) at each side of the base 116 and cover 118 provide for conventional panel mounting of the assembled connector. A stacking bar 214 is provided on the top of cover 118, and corresponding arms (not illustrated) may be provided on the bottom of base 116 for stacking a plurality of the assembled connectors.

What is claimed is:

1. An electrical connector for insulated wires comprising, a terminal for each wire comprising a flat member having an opening therein including a pair of spaced opposing contact lips extending in said opening, and a pair of insulation-skiving blades, each insulation skiving blade substantially parallel with said flat member and overlying a contact lip; and an insulated housing comprising a base and a cover engageable with the base, said base having a surface for receiving each terminal and an opening in the surface for receiving a wire inserted between said contact lips, and the cover having a surface with means projecting toward said base for engaging an insulated wire positioned in the connector bridging said insulation skiving blades and forcing the wire between said blades, skiving the insulation to expose the wire, and engaging the wire with said contact lips, when the cover is engaged with the base.

2. An electrical connector, as recited in claim 1, each insulation skiving blade including an edge having one or more V-shaped serrations.

3. An electrical connector, as recited in claim 1, said opening being rectangular and said contact lips extending inwardly in said opening from longitudinally opposing ends of said opening.

4. A terminal for an insulated wire comprising a flat member having an opening therein including a pair of spaced opposing wire contact lips extending in said opening, and a pair of insulation skiving blades, each insulation skiving blade substantially parallel with said flat member and overlying a contact lip.

5. A terminal, as recited in claim 4, each insulation skiving blade including an edge having one or more V-shaped serrations.

6. A terminal, as recited in claim 4, said opening being rectangular and said contact lips extending inwardly in said opening from longitudinally opposing ends of said opening.

7. A self-stripping terminal for an insulated wire comprising a flat member having a contact lip extending therefrom and an insulation skiving blade substantially parallel with said flat member and overlying said contact lip.

8. A terminal, as recited in claim 7, said insulation skiving blade including an edge having one or more V-shaped serrations overlying said contact lip.

9. An electrical connector assembly comprising one or more insulated wires, a terminal for each wire comprising a flat member having an opening therein including a pair of spaced opposing contact lips extending in said opening, and a pair of insulation skiving blades, each blade substantially parallel with said flat member and overlying a contact lip, and an insulated housing comprising a base and a cover engaged with said base; said base having a surface receiving each terminal and an opening in each surface receiving each wire inserted between said contact lips, and the cover having a surface with means projecting toward said base engaging an exposed portion of each insulated wire in the connector assembly with said blades and said contact lips.

10. An electrical connector assembly, as recited in claim 9, said insulation skiving blades including an edge having one or more V-shaped serrations overlying said contact lips.

* * * * *